United States Patent [19]

Shimizu

[11] Patent Number: 4,861,012

[45] Date of Patent: Aug. 29, 1989

[54] PAPER FEEDER FOR IMAGE FORMING APPARATUS

[75] Inventor: Tadafumi Shimizu, Osaka, Japan

[73] Assignee: Minolta Camera Kabushiki Kaisha, Osaka, Japan

[21] Appl. No.: 157,270

[22] Filed: Feb. 18, 1988

[30] Foreign Application Priority Data

Feb. 20, 1987 [JP] Japan ..... 62-38852

[51] Int. Cl.[4] ..... B65H 3/06; B65H 5/06

[52] U.S. Cl. ..... 271/3.1; 271/118; 271/226; 355/308

[58] Field of Search ..... 271/3.1, 4, 114, 116, 271/117, 118, 10, 291, 301, 251, 3, 226; 355/3 SH, 14 SH, 24, 26

[56] References Cited

U.S. PATENT DOCUMENTS

| | | | |
|---|---|---|---|
| 3,612,513 | 10/1971 | Godlewski | 271/37 |
| 3,981,497 | 9/1976 | Feinstein et al. | 271/126 |
| 4,372,547 | 2/1983 | Yanagawa et al. . | |
| 4,540,166 | 9/1985 | Massengeil et al. | 271/3.1 |
| 4,697,911 | 10/1987 | Kajita et al. | 355/3 SH |
| 4,734,738 | 3/1988 | Yamanaka et al. | 355/14 SH |

FOREIGN PATENT DOCUMENTS 62-6269 1/1987 Japan .

*Primary Examiner*—Joseph J. Rolla
*Assistant Examiner*—Steve Reiss
*Attorney, Agent, or Firm*—Burns, Doane, Swecker & Mathis

[57] ABSTRACT

A paper feeder for an image forming apparatus, which includes an intermediate tray for temporarily accommodating a paper having an image already formed on at least one side thereof, a paper feeding roller for feeding out the paper stored in the intermediate tray, a first support for supporting the paper feeding roller in such a manner as to be moved between a paper feeding position at which the paper feeding roller is allowed to contact the paper and a retracting position at which the paper feeding roller is separated from the paper. An oblique travel preventing roller is also provided, disposed parallel to the axis of the paper feeding roller and adapted to prevent the paper from being advanced obliquely. A second support supports the oblique travel preventing roller in such a manner as to be moved between the paper feeding position at which the oblique travel preventing roller is allowed to contact the paper and the retracting position at which the oblique travel preventing roller is separated from the paper. A driving mechanism moves the paper feeding roller and the oblique travel preventing roller to the retracting position.

15 Claims, 5 Drawing Sheets

PAPER FEEDER FOR IMAGE FORMING APPARATUS

BACKGROUND OF THE INVENTION

1. Field of the Invention

This invention relates to a paper feeder for an image forming apparatus. More particularly, it relates to a paper feeder for an image forming apparatus such as an electrophotographic copying machine or a laser printer, especially to paper refeeder in an intermediate tray for an image forming apparatus capable of producing a composite image or images one each on the opposite sides of the copy paper.

2. Description of the Prior Art

In recent years, various image forming apparatuses have been developed, some of the type possessing a composite image function for producing different images in a composite pattern on one side of a copy paper and others of the type possessing a double-faced image function for producing images one each of the opposite sides of the copy paper. The effectuation of a function of this nature requires a copy paper having an image already formed thereon to be placed temporarily in an intermediate tray and then fed out again.

For examples, a copying machine disclosed in Japanese Patent Laid-Open SHO 62(1987)-6,269 will be described below with reference to FIG. 1. Paper storage cases 1 and paper feeding means 2 are disposed in the lower compartment and an intermediate tray unit 3 is disposed directly above the paper storage cases 1 mentioned above. An image forming part 5 centering around a photosensitive drum 4 is disposed in the middle compartment and an optical system 1 in the upper compartment. From the paper storage cases 1, copy papers are forwarded one by one to the image forming part 5 by the paper feeding means 2. A given image projected on the photosensitive drum 4 by the optical system 6 forms a reproduced image on one side of a copy paper. Then, the copy paper carrying the reproduced image is passed through a fixing part 7 and discharged as finished into a paper discharge tray 9 by switching means 8 or forwarded int the aforementioned intermediate tray unit 3.

The intermediate tray unit 3 is provided with an intermediate tray 10, switching means 11, a transfer passage 12 having two transferring rollers 120, and 121, a reverse passage 13, and paper refeeding means 14. It is so constructed that the copy paper brought in toward the intermediate tray unit 3 is transferred by the switching means 11 into the intermediate tray 10 either directly or via the transfer passage 12 and the reverse passage 13, and then fed out again by the paper refeeding means 14 to the image forming part 5. The paper refeeding means 14 is supported in a cantilever fashion, as illustrated in FIG. 2, by a roller shaft 17 projecting after the fashion of a cantilever and having a paper refeeding roller 15 rotatably supported on a holder 16. The holder 16 is supported on a rotary shaft 18 which is rotatably attached to the intermediate tray 10. This rotary shaft 18 is rotated in the direction of an arrow by driving means not shown in the diagram, with the rotation thereof transmitted to a paper refeeding roller 25 via pulleys 19, 20 and a timing belt 21. An operating lever 22 is relatively rotatably attached to one end of the rotary shaft 18 and is suitably stopped at a desired position by driving means 23. Thus, it allows the paper refeeding roller 15 to be positioned at any of the three, i.e. upper, middle, and lower, levels. In the construction described above, therefore, the paper refeeding roller 15 will be positioned on the upper level while the copy paper is being transferred through the reverse passage 13, on the middle level while the copy paper is being transferred directly from the switching means 21, and on the lower level while the copy paper is in the process of being refed.

During the course of the refeeding of the copy paper, regulating guide plates 24 regulate the opposite edge of copy papers P in the intermediate tray 10 as illustrated in FIG. 3 and the paper refeeding roller 15 sends the blank copy papers P out one by in the direction of nipping roller 25. When the copy paper P on the top is to be sent out by the paper refeeding roller 15, it tends to advance obliquely because it is susceptible of a few forms of resistance such as the frictional resistance produced between the lower side of the copy paper P in motion and the upper side of the next copy paper P, the adhesive resistance caused by static electricity, and the frictional resistance caused by the sliding contact of the paper P in motion with the guide members. Particularly when the copy papers are positioned by one side only, the paper P in motion is more liable to travel obliquely because the paper refeeding roller 15 cannot be disposed at the center of the stack of copy papers P. To prevent the paper P in motion from advancing obliquely, the regulating guide plates 24 are disposed in the manner described above.

The regulating guide plates 24 designed for the regulation under discussion, however, are incapable of precisely regulating the opposite edges of the copy papers P as illustrated in FIG. 4. When the paper P in motion has been heat curled owing to the travel thereof through the fixing part 7 (particularly so when the atmosphere is highly moist) or when the paper P in motion is thin and deficient in nurve. Thus, it is difficult to prevent the paper P in motion from advancing obliquely.

An object of this invention, therefore, is to provide a novel paper feeder for an image forming apparatus.

Another object of this invention is to provide a paper refeeder for an image forming apparatus, which by means of a simple mechanism enables a copy paper temporarily stored in an intermediate tray to be fed out without inducing any oblique advance, no matter whether the paper P is heat curled or lacks nurve.

SUMMARY OF THE INVENTION

The objects described above are accomplished by a paper feeder for an image forming apparatus, which comprises an intermediated tray for accommodating a copy paper having an image already formed on at least one side thereof, a paper feeding roller for feeding out the copy paper stored in the intermediate tray, first supporting means for supporting the paper feeding roller in such a manner as to be moved between the paper feeding position at which the paper feeding roller is allowed to contact the copy paper and the retracting position at which the paper feeding roller is separated from the copy paper, an oblique travel preventing roller disposed parallel to the axis of the paper feeding roller and adapted to prevent the copy paper from being advancing obliquely, second supporting means for supporting the oblique travel preventing roller in such a manner as to be moved between the paper feeding position at which the oblique travel preventing roller is allowed to contact the copy paper and the retracting position at which the oblique travel preventing roller is separated from the copy paper, and driving means for moving the paper feeding roller and the oblique travel preventing roller to the retracting position.

The objects described above are also accomplished by an image forming apparatus provided with an intermediate tray for temporarily accommodating a copy paper having an image already formed on at least one side thereof and a paper feeding roller capable of producing a rotary motion for refeeding said copy paper from within said intermediate tray, which comprises: first supporting means supported swingably above said intermediate tray and adapted to support said paper feeding roller at the leading end thereof, second supporting means supported so as to be rotated around the axis of said paper feeding roller and adapted to support rotatably at the leading end thereof an oblique travel preventing roller parallelly to the axis of said paper feeding roller, and a lever supported swingably above said intermediate tray and adapted to revolve said paper feeding roller and said oblique travel preventing roller from the paper feeding position to the retracting position outside the paper passage by being joined to said first supporting means and said second supporting means.

In the paper refeeder of the present invention for an image forming apparatus, owing to the provision of the oblique travel preventing roller disposed parallelly to the paper refeeding roller, the copy paper can be fed out without inducing any oblique advance no matter whether the copy paper has been heat curled because of the passage thereof through the fixing part or the copy paper is deficient in nurve. Moreover, since this oblique travel preventing roller is retractable, it offers no hindrance whatever to the copy paper while the copy paper is being transferred into the intermediate tray. Since the prevention of the oblique travel of the copy paper is accomplished simply by providing the paper feeder with the oblique travel preventing roller, the paper feeder enjoys outstanding effects such as simplicity of construction.

EXPLANATION OF THE PREFERRED EMBODIMENT

Now, one preferred embodiment of the present invention will be described with reference to FIG. 1 and FIGS. 5 to 11.

This embodiment is identical in overall structure with the conventional paper feeder described above with reference to FIG. 1. The description of this embodiment, therefore, is omitted herein because the foregoing description is available for ready reference.

Figure 1:
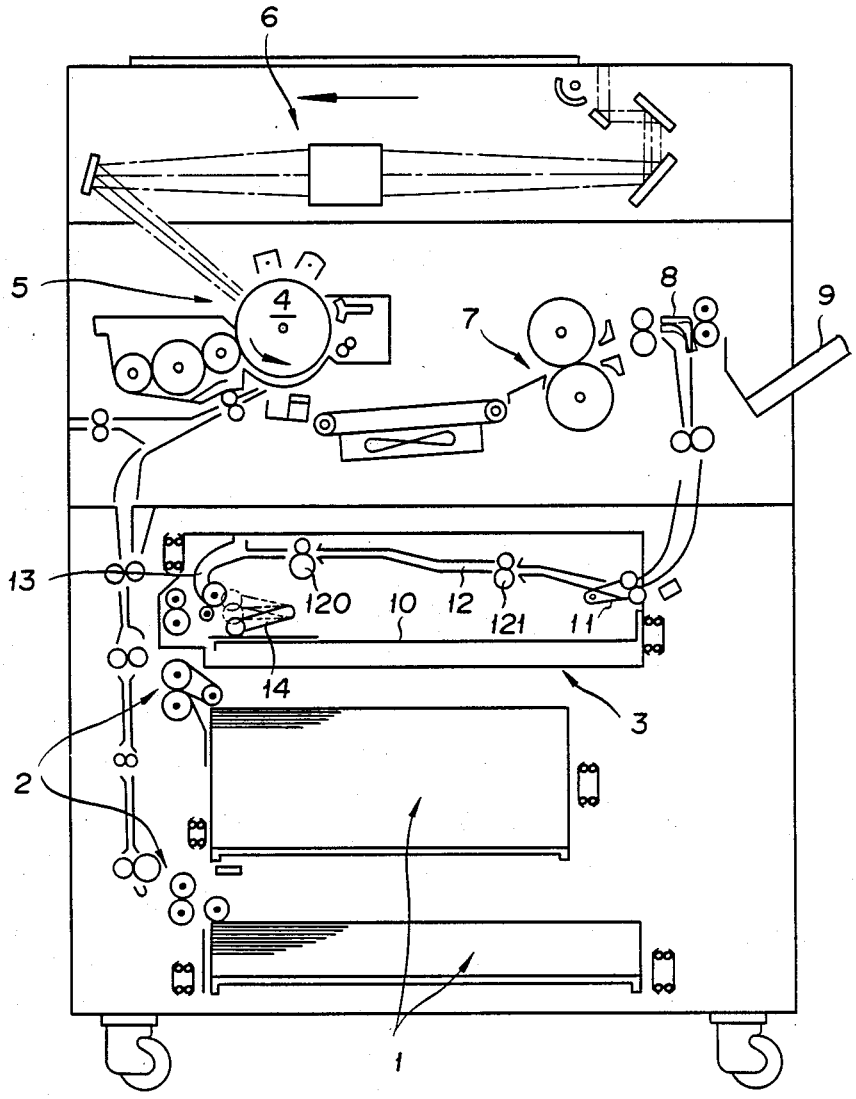
FIG. 1 is an overall structural diagram of a copying machine.
Figure 2:
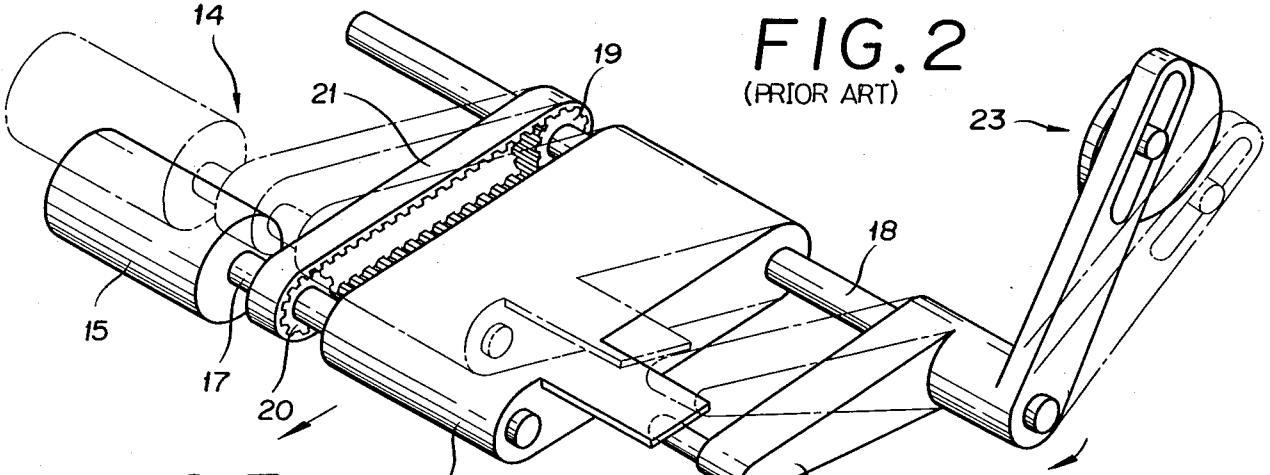
FIG. 2 (PRIOR ART)
FIG. 2 is a perspective view illustrating the structure of a conventional paper feeder.
Figure 3:
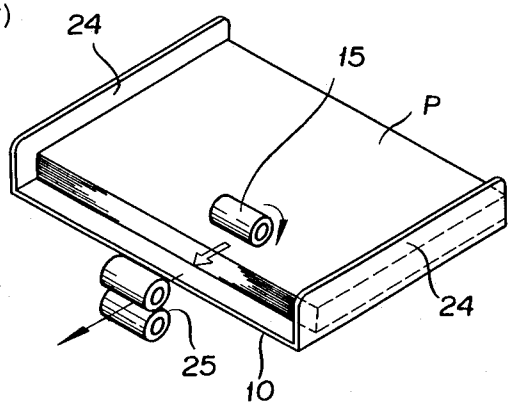
FIG. 3 (PRIOR ART)
FIGS. 3 and 4 are perspective views for illustrating varied states of operation of the conventional paper feeder.
Figure 4:
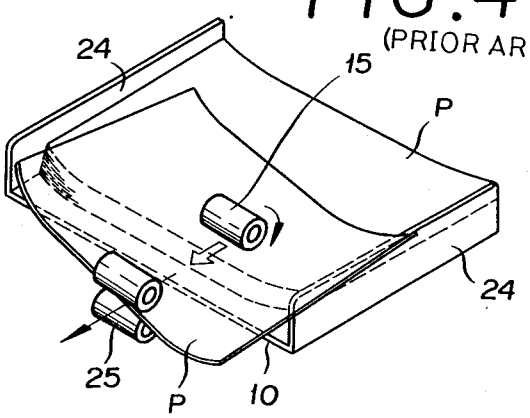
FIG. 4 (PRIOR ART)
Figure 5:
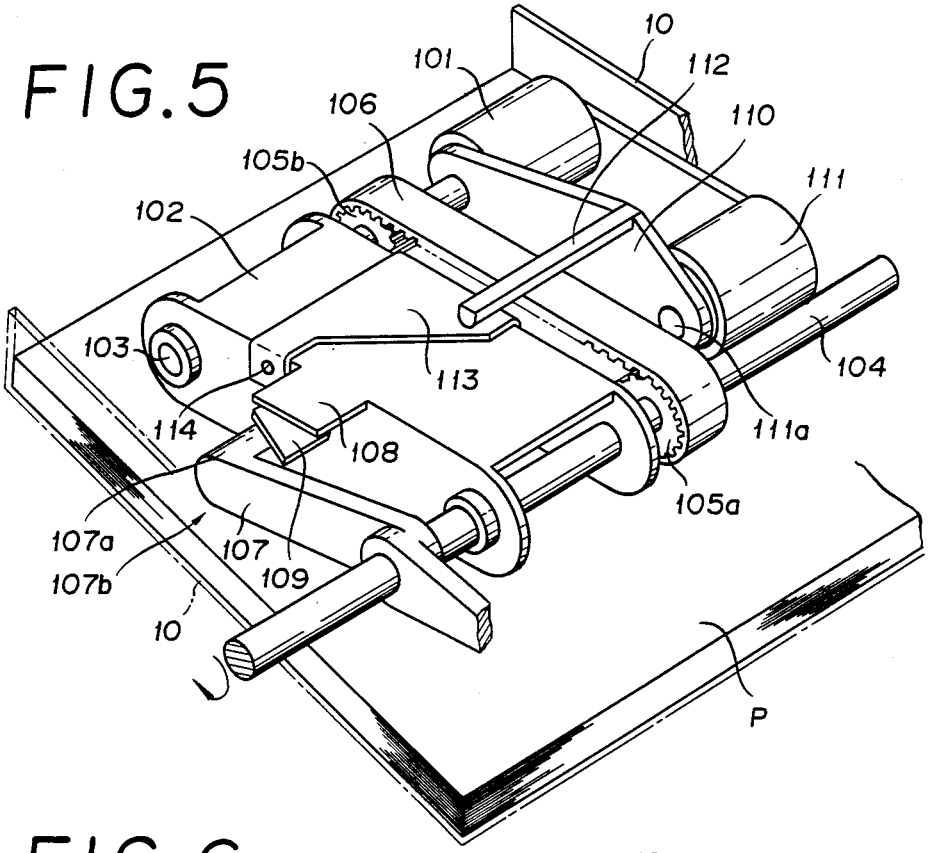
FIG. 5 is a perspective view illustrating the essential parts of a paper feeder of the present invention.
Figure 6:
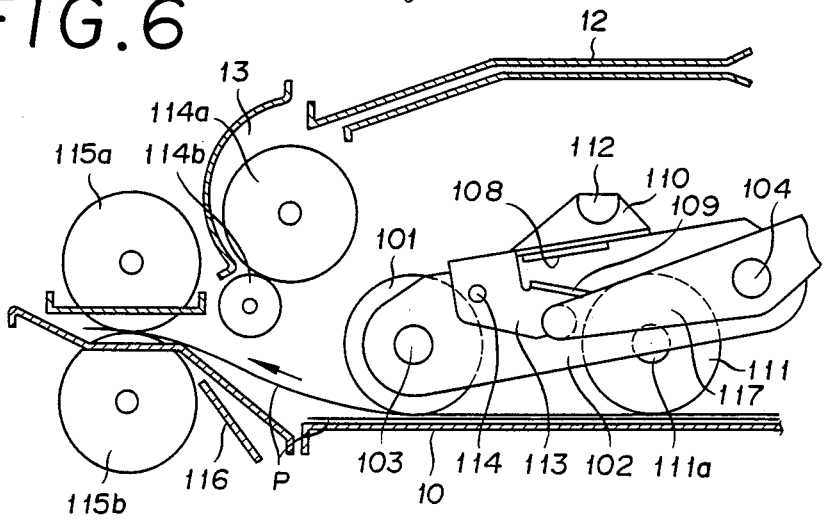
FIGS. 6 to 8 are side views illustrating varied states of operation of the paper feeder according with the present invention.

As illustrated in FIGS. 5 and 6, a paper feeding roller 101 is supported on a roller shaft 103 in a cantilever fashion and supported rotatably on a first holder 102. The surface of this paper feeding roller 101 is formed with a rubbery material of high frictional coefficient. The first holder 102 is supported in such a manner as to be freely swung vertically by a rotary shaft 104 which in turn is rotatably attached to an intermediate tray 10 (FIG. 1). This rotary shaft 104 is rotated in the direction of an arrow by driving means not shown in the diagram. This rotation is transmitted to the paper refeeding roller 101 via a pulley 105*a* and a timing belt 106 or a chain or some other suitable means of transmission of motive force and a pulley 105*b* fixed on the roller shaft 103. An operating lever 107 is relatively rotatably attached coaxially to one end of the rotary shaft 104. As described fully later on, this operating lever 107 is provided with driving means which enables the operating lever to be set at any of the three angular positions, i.e. the lower, middle, and upper angular positions. A projecting piece 108 adapted to be pushed up by an actuating part 107*a* formed at the leading end of the operating lever 107 protrudes from one side of the central part of the first holder 102. On the roller shaft 103, a second holder 110 is relatively rotatably attached in such a manner that the roller shaft 103 and the second holder 110 will be opposed to each other across the paper refeeding roller 101. To the free end of the second holder 110, an oblique travel preventing roller 111 is attached in such a manner as to be freely rotated around a supporting shaft 111*a*. The surface of this oblique travel preventing roller 111 is formed with a rubbery material of high frictional coefficient. This oblique travel preventing roller 111 is disposed parallelly to the axis of the paper refeeding roller 101. From one side of the second holder 110, a projecting lever 112 is extended toward the upper angular position of the first holder 102. A lifting member 113 adapted to impart a lifting motion on the projecting lever 112 is pivotally supported on one lateral surface of the first holder 102 in such a manner as to be freely revolved vertically by a pivotally supporting pin 114. A moved piece 109 is extended from the lifting member 113 in such a manner as to assume a position between an operating part 107*a* of the operating lever 107 and the projecting piece 108 of the first holder 102.

Figure 7:
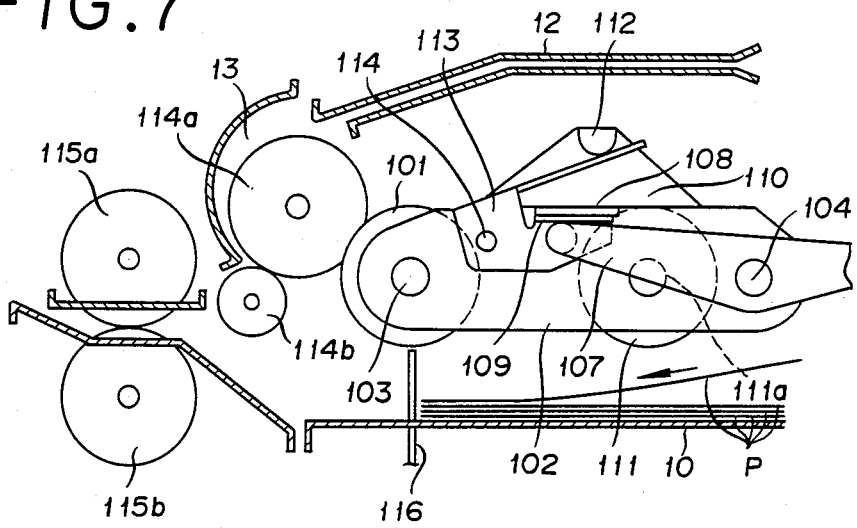
Figure 8:
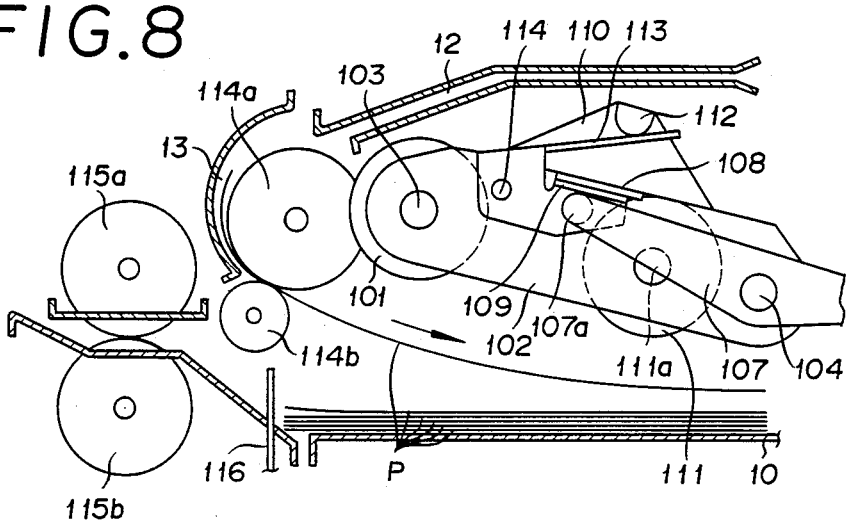

In FIGS. 6 to 8, the symbols 114*a* and 114*b* stand for transfer rollers of the reverse passage an the symbols 115*a* and 115*b* for nipping rollers for refeeding copy papers one by one. The symbol 116 stands for a paper stopper for effecting positional regulation of the edges of copy papers P being brought in to the intermediate tray 10. This paper stopper 116 is retracted as illustrated in FIG. 6 while the refeeding of a copy paper is in process, positioned as aligned with the paper refeeding roller 101 as illustrated in FIG. 7 so as to prevent the copy paper from flying out while the copy paper is being brought in for the production of a composite image, and enabled to effect positional regulation of the rear edge of the copy paper relative to the direction of transfer as illustrated in FIG. 8. To be more specific, the rotation of the operating lever 107 first causes the oblique travel preventing roller 111 to depart from the upper surface of the copy paper P and then causes the paper refeeding roller 101 to depart similarly.

Figure 9:
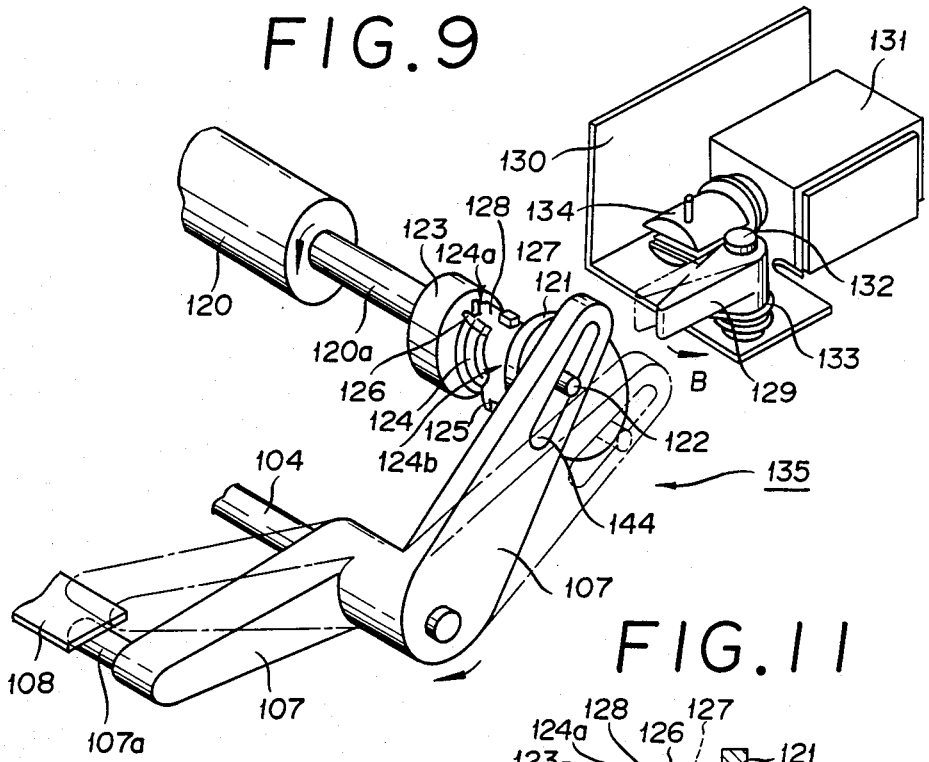
FIG. 9 is a perspective view illustrating a mechanism for swinging the paper refeeding roller.
Figure 11:
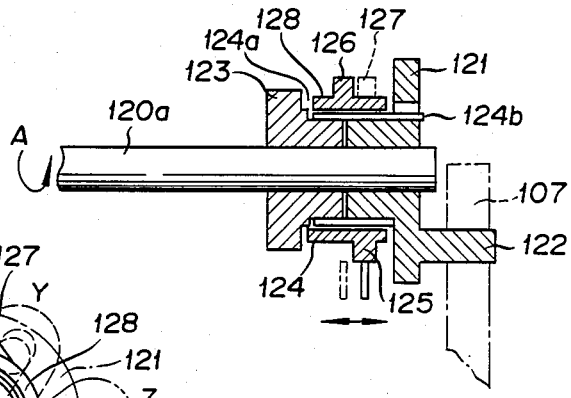
FIG. 11 is a cross section of clutch means.
Figure 10:
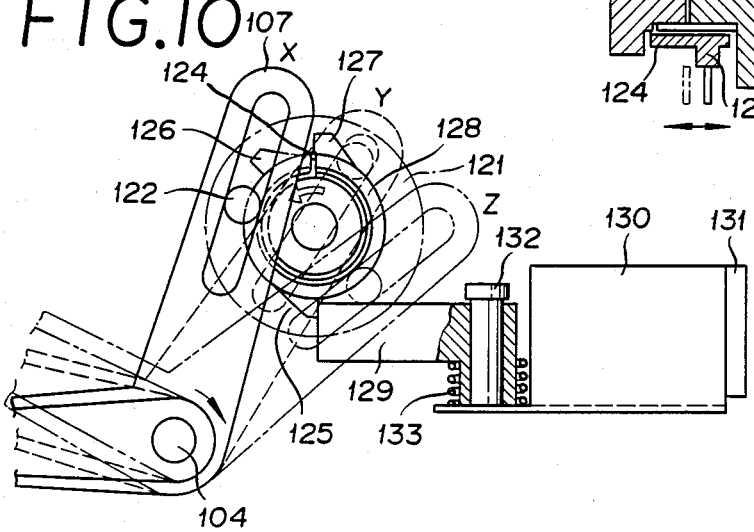
FIG. 10 is an explanatory diagram illustrating the operation of the mechanism for swinging the paper refeeding roller.

The operating lever 107 is so constructed that it will be set by the driving means 135 at any of the three angular positions, i.e. the lower, middle, and upper positions as illustrated in FIGS. 9 to 11. Specifically, the operating lever 107 is relatively rotatably attached to one end of the rotary shaft 104. The shaft 107*a* projected from one end of the operating lever 107 is opposed upwardly to the projecting piece 108 of the first holder 102. In a long hole 144 formed at the other end of the operating lever 107, a pin projected from a clutch plate 121, rotatably attached to the supporting shaft 120*a* of the transferring roller 120 of the transfer passage 12 is idly inserted. In the terminal part of the supporting shaft 102*a*, another clutch plate 123 is fixed as illustrated in FIG. 9. A kick spring 124 is wound around each of the bosses of the clutch plates 121 and 123. A collar 128 provided with claws 125, 126, and 127 is fitted around the kick spring 124. One end 124*a* of the kick spring 124 is kept in engagement with the collar 128 and the other end 124*d* thereof with the clutch plate 121. In this construction, the kick spring 124 in a free state clamps the bosses of the clutch plates 121 and 123 and transmits the rotation of the supporting shaft 120*a* in the direction of an arrow A from the clutch plate 123 to the clutch plate 121 and the collar 128. When the collar 128 is restrained from rotation thereof by a lever 129 which will be described fully later on, the rotation in the direction of the arrow A so far transmitted from the supporting shaft 102*a* to the clutch plate 123 acts in the direction of rewinding the kick spring 124 and the clutch plate 123 produces rotational slip on the kick spring 124. Thus, the rotational force is not transmitted to the clutch plate 121.

Means for actuating the clutch means described above is composed of a solenoid 131 and a lever 129 which are attached to a fitting plate 130 as illustrated in FIG. 9. The lever 129 is swingably attached to a supporting shaft 132, kept urged constantly in the direction of an arrow B by the resilient force of a coil spring 133 wound around the lower part thereof, and controlled in a position indicated by a solid line in FIG. 9 with a stopper not shown in the diagram. The lever 129 is connected to a plunger 134 of the solenoid 131. When the lever 12 is turned on and the plunger is moved back, the lever 129 is swung at a position indicated by a chain line. The leading end of the lever 129 is positioned on the locus of the rotation of the claws 125, 126, and 127 of the collar. When the lever 129 is set at the position of the solid line, it is allowed to contact the claws 125 and 127. When the lever 129 is set at the position of the chain line, it is allowed to contact the claw 126.

When the lever 129 is set at the position (X-position) of the solid line, the claw 125 comes into contact with the leading end of the lever 129 as illustrated in FIGS. 9 to 11. Since the operating lever 107 consequently has one end thereof kept at the highest level, the acting point 107*b* at the other end is caused to fall. As the result, the paper refeeding roller 101 which is disposed coaxially with the roller shaft 103 of the first holder 102 is pressed down on the copy paper P (FIG. 6). When the lever 129 is swung to pass the claw 125 and then bring the claw 126 into contact with the leading end of the lever 129, one end of the operating lever 107 reaches the middle (Y-position) indicated by the broken line to raise the point of action 107*b*, push up the moved piece 109, set the lifting member 113 rotating, push up the projecting lever 112 of the second holder 110, and elevate the oblique travel preventing roller 111 (FIG. 7). When the lever 129 is further swung to pass the claw 126 and bring the next claw 127 into contact with the leading end of the lever 129, one end of the operating lever 107 reaches the lower (Z-position) indicated by the line of alternate one-long and two-short dashes to elevate the point of action 107*b* further and move the oblique travel preventing roller 111 away upwardly.

In the construction of the foregoing description, the operating lever 107 is set at the lower position as illustrated in FIG. 6 and the operating part 107*b* thereof is disposed below the moved piece 109 across an intervening space when the copy paper P is being fed out again. At the same time, the paper refeeding roller 101 is kept pressed with prescribed paper feeding pressure against the copy paper P by the weight of the first holder 102. Similarly, the oblique travel preventing roller 111 is kept in close contact with the upper surface of the copy paper P by the weight of the second holder 110 (FIG. 6). When the rotary shaft 104 is rotated clockwise, the paper refeeding roller 101 is rotated clockwise through the medium of the timing belt 106 and, as the result, the copy papers P are fed out one by one in the direction of the nipping rollers 115*a*, 115*b*. In this case, the oblique travel preventing roller 111 is sympathetically rotated as held in tight contact with the upper surface of the copy paper P. Even when the copy paper P happens to be exposed to any lateral force relative to the direction of paper feed, i.e. the direction of rotation of the oblique travel preventing roller 111, it is prevented from being diverted sideways owing to powerful gripping force generated between the surface of the oblique travel preventing roller 111 and the upper surface of the copy paper P. Consequently, the otherwise possible oblique travel of the copy paper P is prevented.

Then, when the copy paper P is transferred directly into the intermediate tray 10 by the switching means 11 for the production of a composite image, the operating lever 107 is set at the middle position as illustrated in FIG. 7. As the result, the operating part 107*b* pushes up the moved piece 109 of the lifting member 113, the lifting member 113 rotates counterclockwise to push up the projecting lever 112 of the second holder 110, and the oblique travel preventing roller 111 lifts itself away the upper surface of the copy paper P. When the lifting member 113 rotates across a prescribed angle, the moved piece 109 collides against the projecting piece 108 of the first holder 102. Then, when the operating lever 107 is rotated clockwise, the first holder 102 rotates itself clockwise. By the motions described above, the paper refeeding roller 101 is lifted to the middle position and, at the same time, the oblique travel preventing roller 111 is retracted upwardly (FIG. 8). As the result, the introduction of the copy paper P is accomplished without any trouble. Further, the copy paper stopper 116 and the paper refeeding roller 101 cooperate in precluding the copy paper from flying out in the direction of paper feed. When a prescribed number of copy papers P have been received, the aforementioned state of paper refeeding is resumed by the operating lever 107 moving to the lower position. The procedure involved in this case is the opposite of the procedure described above. After the paper refeeding roller 101 contacts the upper surface of the copy paper P, the oblique travel preventing roller 111 comes into contact therewith.

When the copy paper P desired to produce images one each on the opposite sides thereof is transferred, with the side for image transfer turned upward, via the transfer passage 12 and the reverse passage 13 to the intermediate try 20, the operating lever 103 is set at the upper position as illustrated in FIG. 8 and, as the result, the first holder 102 is rotated further upwardly from the aforementioned middle position and the paper refeeding roller 101 is moved upwardly and brought to a stop. Similarly the oblique travel preventing roller 111 is retracted upwardly and offers no hindrance to the passage of the copy paper P toward the paper storage case.

In the embodiment described above, the intermediate tray unit 3 for the production of a composite image on one side of a copy paper or images one each on the opposite sides of a copy paper has been portrayed as one using an intermediate tray 10 adapted to receive copy papers P from both ends thereof. Of course, this invention is similarly embodied where the intermediate tray 10 is adapted to admit copy papers exclusively from one end thereof.

Further in the present embodiment, since the second holder 110 supporting the oblique travel preventing roller 111 is connected to the shaft of the paper refeeding roller 101, the second holder 110 is laid substantially parallelly to the surface of the copy paper. When the copy paper is sent out by the paper refeeding roller 101, therefore, the oblique travel preventing roller is allowed to exert fixed pressure upon the copy paper. To be specific, since the force of movement exerted by the frictional force upon the oblique travel preventing roller is directed toward the fulcrum, the force serving to hold down the copy papers is not adversely affected at all.

What is claimed is:

1. A paper feeder for an image forming apparatus, which comprises:

an intermediate tray for temporarily accommodating a paper having an image already formed on one side thereof;

paper transporting means for transporting the paper into the intermediate tray;

a paper feeding roller for feeding out the paper stored in said intermediate tray;

first supporting means for supporting said paper feeding roller movable between a paper feeding position where said paper feeding roller is in contact with the paper and a retracting position where said paper feeding roller is separated from the paper;

an oblique travel preventing roller for preventing the paper from being advanced obliquely, said oblique travel preventing roller being disposed parallel to said paper feeding roller;

second supporting means for supporting said oblique travel preventing roller movable between a paper contact position there said oblique travel preventing roller is in contact with the paper and a retracting position where said oblique travel preventing roller is separated from the paper; and driving means for driving said first supporting means and said second supporting means so that said paper feeding roller and said oblique travel preventing roller repositioned in the retracting position, respectively, when the paper is transported into the intermediate tray.

2. A paper feeder according to claim 1, wherein said first supporting means is provided at the leading and thereof with said paper feeding roller and rotatably supported in the upper part of said intermediate tray and said second supporting means is provided at the leading end thereof with said oblique travel preventing roller and supported so as to be freely rotated about the axis of said paper feeding roller.

3. A paper feeder according to claim 2, wherein said oblique travel preventing roller is kept in contact with the paper by its own weight.

4. A paper feeder according to claim 2, wherein said second supporting means is adapted to be synchronized with the swinging motion of said first supporting means.

5. A paper feeder according to claim 4, wherein said second supporting means is provided with a projecting lever having a position wherein said lever is contacting the surface of said first supporting means and adapted to enable said oblique travel preventing roller to be moved between the position for contact with the paper and the position for separation from the paper in consequence of the swinging motion of said first supporting means.

6. A paper feeder according to claim 2, wherein said paper feeding roller is supported on a roller shaft rotatably supported at the leading end of said first supporting means.

7. A paper feeder according to claim 6, wherein said paper feeding roller is supported on said roller shaft in a cantilever fashion.

8. A paper feeder according to claim 1, wherein said driving means includes a lever having a position wherein said lever is connected to said first supporting means and said second supporting means.

9. A paper feeder according to claim 8, wherein said lever is connected at the leading end thereof to said first supporting means and further connected to said second supporting means through said first supporting means.

10. A paper feeder according to claim 9, wherein said lever is actuated by clutch means disposed on the rotary shaft of a driving means.

11. A paper feeder according to claim 8, wherein said paper feeding roller is driven by a motive force transmitting means adapted to be joined to a rotary shaft disposed coaxially with the fulcral axis of said lever.

12. An image forming apparatus provided with an intermediate tray for temporarily accommodating paper having an image already formed on at least one side thereof and a paper feeding roller producing a rotary motion for refeeding the paper from within said intermediate tray, which comprises:

first supporting means supported swingably above said intermediate tray and adapted to support said paper feeding roller at the leading end thereof, second supporting means supported so as to be rotated around the axis of said paper feeding roller and adapted to support rotatably at the leading end thereof an oblique travel preventing roller parallelly to the axis of said paper feeding roller, and a lever supported swingably above said intermediate tray and adapted to revolve said paper feeding roller and said oblique travel preventing roller from the paper feeding position to the retracting position outside the paper passage by being connected to said first supporting means and said second supporting means.

13. An apparatus according to claim 12, wherein said oblique travel preventing roller is disposed at a position on the side of said paper feeding roller opposite to the fulcrum of said first supporting means.

14. An apparatus according to claim 12, wherein said oblique travel preventing roller is kept in contact with the paper by its own weight.

15. An apparatus according to claim 12, which further comprises driving means for moving said paper feeding roller and said oblique travel preventing roller to the retracting position.

* * * * *